US005881614A

United States Patent [19]

Cheng-Tsan

[11] Patent Number: 5,881,614

[45] Date of Patent: Mar. 16, 1999

[54] TOOL WITH REVERSIBLE BIT AND METHOD OF ASSEMBLY

[75] Inventor: Hu Cheng-Tsan, Tainan Hsien, Taiwan

[73] Assignee: Millers Falls Tool Company, Cincinnati, Ohio

[21] Appl. No.: 762,321

[22] Filed: Dec. 9, 1996

[51] Int. Cl.[6] ..... B25B 23/00

[52] U.S. Cl. ..... 81/438; 81/177.4; 279/102

[58] Field of Search ..... 81/437–439, 490, 81/177.1, 177.4; 279/102, 79–80; 403/309, 366, 372, 399, 361, 357–358

[56] References Cited

U.S. PATENT DOCUMENTS

| | | | |
|---|---|---|---|
| 772,593 | 10/1904 | Wagner . | |
| 2,158,728 | 5/1939 | Peters . | |
| 2,476,762 | 7/1949 | Petre et al. | 81/438 X |
| 2,483,563 | 10/1949 | Rock | 81/438 X |
| 2,596,594 | 5/1952 | Petre | 81/439 X |
| 2,805,594 | 9/1957 | Fogel | 279/79 X |
| 2,845,274 | 7/1958 | Peterson | 279/79 X |
| 3,455,355 | 7/1969 | McLogan et al. . | |
| 4,404,874 | 9/1983 | Lieser . | |
| 5,335,409 | 8/1994 | Elvebak . | |
| 5,481,949 | 1/1996 | Yen | 81/438 |
| 5,533,429 | 7/1996 | Kozak | 81/439 |

*Primary Examiner*—D. S. Meislin

*Attorney, Agent, or Firm*—Killworth, Gottman, Hagan & Schaeff, L.L.P.

[57] ABSTRACT

A tool having a handle and including a sleeve and a spring is provided which is simple and cost effective to manufacture. The sleeve is provided with a slot and the spring is positioned so that a portion of the spring extends through the slot. The sleeve is positioned in a bore in the handle. A removable, reversible bit is held in the handle by the sleeve and the spring. The spring applies sufficient force to the bit to retain the bit within the handle. The sleeve also prevents the bit from rotating relative to the handle. The bit may be removed from the handle by pulling the bit away from the handle. The same end of the bit, another end of the bit, or a different bit may be reinserted in the handle.

23 Claims, 3 Drawing Sheets

TOOL WITH REVERSIBLE BIT AND METHOD OF ASSEMBLY

BACKGROUND OF THE INVENTION

The present invention relates to tools such as hand tools, and more particularly to tools such as screwdrivers having reversible bits and methods of assembling such tools.

Tools, including screwdrivers, are known which include a handle, a work-engaging tip or bit, and some structure for mounting the bit to the handle. Some tools, including screwdrivers, are also known in which the mounting of the bit to the handle is temporary such that the bit may be removed and replaced with another bit. Still other tools include reversible bits in which opposite ends of a shaft contain different bits (such as a flat blade and Phillips head), and the shaft can be removed from the tool handle and the bit reversed.

Examples of such tools include Wagner, U.S. Pat. No. 772,593; McLogan et al, U.S. Pat. No. 3,455,355; Peters, U.S. Pat. No. 2,158,728; Lieser, U.S. Pat. No. 4,404,874; and Elvebak, U.S. Pat. No. 5,335,409. All of these references describe different parts and methods of construction for reversible bit tools. There remains a need in this art for such tools, including screwdrivers, which are reliable, easy to use, and simple and cost effective to manufacture.

SUMMARY OF THE INVENTION

The present invention meets that need by providing a tool, a handle, and a method of assembly which is reliable, easy to use, and simple and cost effective to manufacture. In accordance with one aspect of the present invention, a reversible bit tool is provided, the tool including a handle having a bore therein and a bit which includes first and second ends, with a shaft extending between the first and second ends. The first end of the bit extends into the bore in the handle and is designed so that it may be readily removed and the opposite end of the bit inserted into the bore in the handle.

A sleeve is mounted in the bore, with the sleeve including an exterior surface engaging the bore of the handle and an interior surface defining a passage therethrough for receiving the shaft of the bit and adapted to prevent rotation of the bit around a longitudinal axis thereof. The sleeve includes a collar and a slot in the sleeve which communicates with the passage. The tool also includes a spring having a first portion which at least partially encircles the collar of the sleeve and a second portion which extends into the slot in the sleeve and frictionally engages a surface of the shaft of the bit to retain the bit in the handle.

The exterior surface of the sleeve preferably includes a plurality of upstanding, longitudinally extending ribs which are designed to frictionally engage the inner surface of the bore in the handle and secure the sleeve therein. The exterior surface of the sleeve may include a substantially smooth portion generally adjacent to said ribs to allow for easy insertion of the sleeve into the bore. The slot in the sleeve is preferably positioned between adjacent ribs, and the second portion of the spring extends between adjacent ribs and into the slot. In a preferred embodiment, there are an absence of ribs in the collar of the sleeve such that neither portion of the spring extends outwardly from the exterior surface of the sleeve beyond the ribs.

The invention also includes a method of assembling a tool handle and includes the steps of providing a handle, sleeve and spring. The handle includes a bore therein which is adapted to receive a sleeve assembly comprising the sleeve and spring. The sleeve includes an exterior surface having a plurality of upstanding, longitudinally extending ribs and an interior surface defining a passage therethrough. The sleeve further includes a collar and a slot in the sleeve communicating with the passage.

The exterior surface of the sleeve may include a substantially smooth portion generally adjacent to said ribs.

The spring includes a first portion adapted to at least partially encircle the collar of the sleeve and a second portion adapted to extend into the slot in the sleeve. The sleeve assembly is formed by sliding the first portion of the sleeve over the collar to frictionally engage the collar and hold the spring in position on the sleeve. The second portion of the spring extends into the slot on the sleeve. The sleeve assembly is then positioned adjacent the bore in the handle, and sufficient pressure is applied to the sleeve assembly to force the sleeve assembly into the bore. The ribs on the sleeve frictionally engage the inner surface of the bore to retain the sleeve assembly in the handle.

Accordingly, it is a feature of the present invention to provide a tool, a handle, and a method of assembly which is reliable, easy to use, and simple and cost effective to manufacture. This, and other features and advantages of the present invention, will become apparent from the following detailed description, the accompanying drawings, and the appended claims.

DETAILED DESCRIPTION OF THE INVENTION

Figure 1:
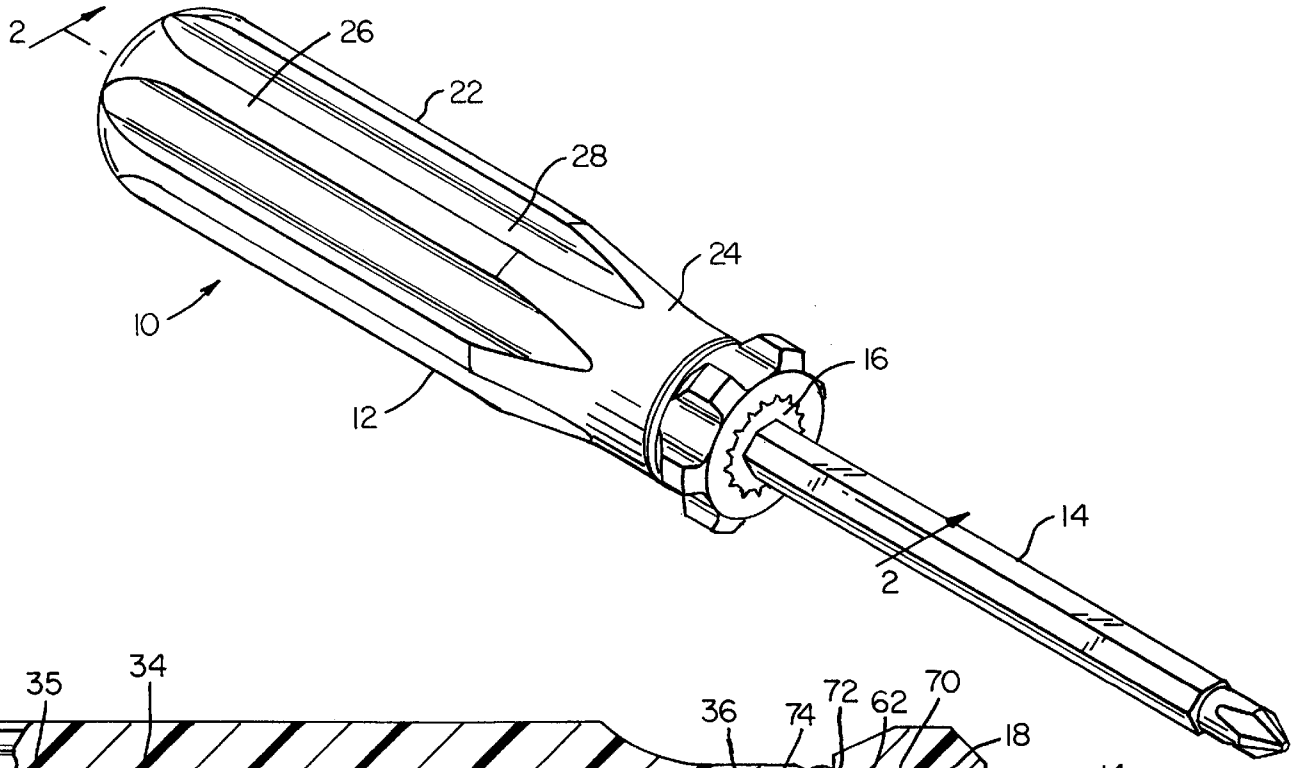
FIG. 1 is a perspective view of the tool according to the present invention.
Figure 2:
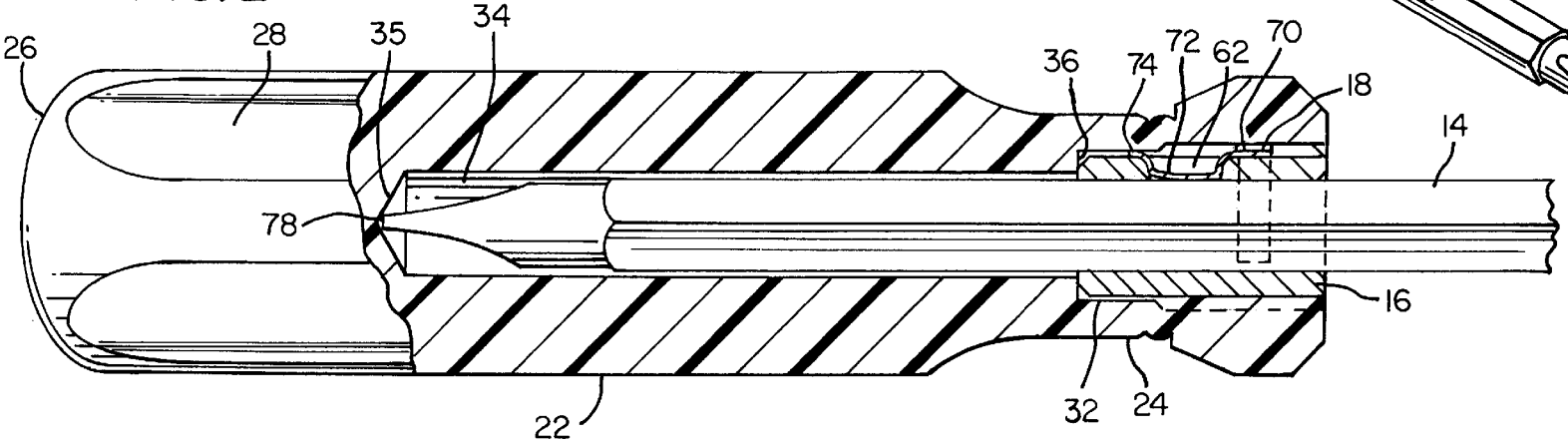
FIG. 2 is cross-sectional view of the tool taken along view line 2—2 in FIG. 1.

Referring now to FIG. 1, a reversible bit tool 10 is shown including a handle 12 and a removable bit 14. As shown in FIG. 2, a sleeve 16 is mounted inside handle 12 and receivably engages bit 14. A spring 18 is coupled to sleeve 16 and frictionally engages bit 14. The force provided by spring 18 against bit 14 maintains bit 14 in handle 12 during use. Bit 14 may be removed from the handle 12 by applying sufficient force along longitudinal axis 20 (see FIG. 7) to overcome the force provided by spring 18.

Handle 12 includes a body portion 22, neck portion 24, and exterior surface 26 having longitudinal slots 28. The shape and size of the longitudinal slots 28 and neck portion 24 are conventional to allow for convenient grasping of the tool by a hand of the user. Handle 12 includes a bore 30 comprising a first cylindrically shaped chamber 32 adapted to receive sleeve 16, a second cylindrically shaped chamber 34 adapted to receive bit 14, and a shoulder 36 positioned between the two chambers. First chamber 32 has greater diameter than second chamber 34; see also FIG. 7. Second chamber 34 includes a beveled end 35 and has a diameter slightly larger than the diameter of bit 14.

Figure 3:
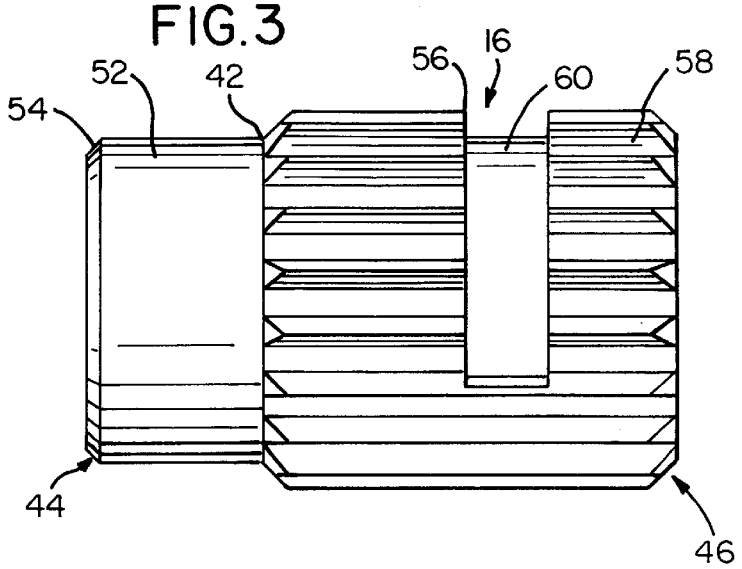
FIG. 3 is a side view of the sleeve.
Figure 5:
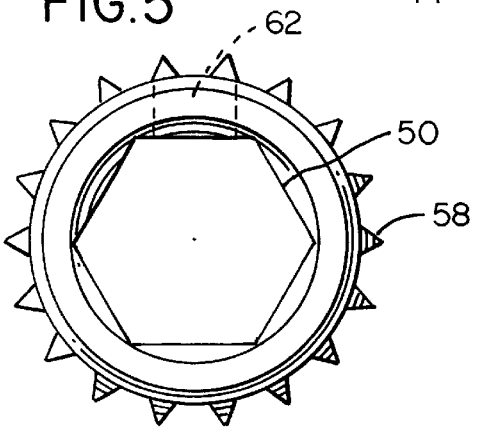
FIG. 5 is a front view of the sleeve.
Figure 4:
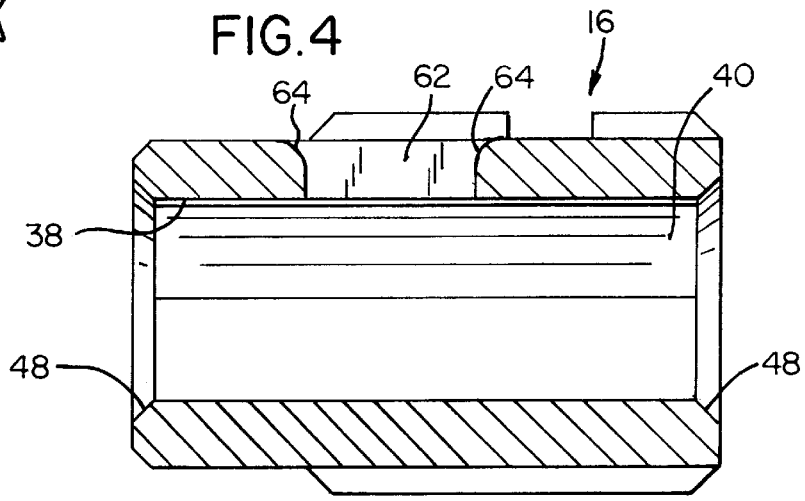
FIG. 4 is cross sectional view of the sleeve taken along view line 4—4 in FIG. 5.

Referring to FIGS. 3–5, sleeve 16 includes an interior surface 38 defining a passage 40 and an exterior surface 42 extending between a first end 44 and a second end 46. Interior surface 38 includes beveled surfaces 48 and, as shown in FIG. 5, hexagonally-shaped inner walls 50 for mating with the reciprocally-shaped hexagonal exterior surfaces of bit 14. Such mated surfaces prevent rotation of bit 14 about its longitudinal axis when inserted in sleeve 16. Exterior surface 42 of sleeve 16 includes a guide portion 52 generally adjacent the first end 44 and having an outer diameter smaller than the diameter of first chamber 32. Guide portion 52 includes a chamfered end portion 54. Exterior surface 42 further includes an enlarged portion 56 extending between guide portion 52 and second end 46 and having a plurality of upstanding, longitudinally extending ribs 58. Ribs 58 define a maximum outer diameter which is larger than the diameter of first chamber 32 in the bore of handle 12. Guide portion 52 is substantially smooth being devoid of ribs 58.

As shown in FIG. 3, enlarged portion 58 of sleeve 16 further includes a collar 60 and a slot 62 communicating with passage 40. Slot 62 is preferably positioned between collar 60 and guide portion 52; see FIG. 4. As will be appreciated by those skilled in the art, the general location of the slot 62 and collar 60 may be reversed without departing from the scope of the present invention. The area defined by collar 60 is preferably void of any ribs 58 while the slot 62 is preferably positioned between adjacent ribs 58. Slot 62 is preferably positioned along one of the flat hexagonal surfaces of portion 50 as shown in FIG. 5. Slot 62 includes rounded portions 64 extending from the exterior surface 42 to interior surface 38 of sleeve 16.

Figure 6:
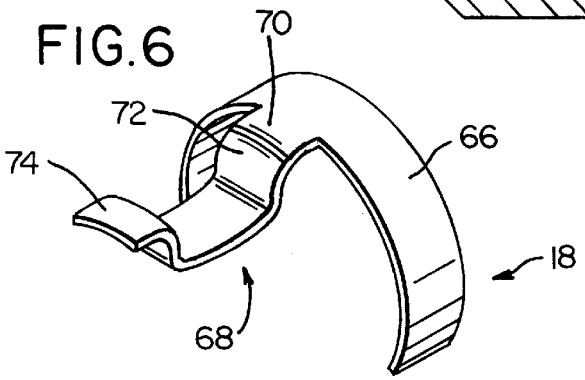
FIG. 6 is a perspective view of the spring.

Referring now to FIG. 6, spring 18 includes a first portion 66 having an arch shape and a second portion 68. Second portion 68 includes a first flat portion 70 extending generally outward from said first portion 66, a curved portion 72, and a second flat portion 74. Spring 18 is positioned on sleeve 16 so that first portion 66 partially encircles collar 60, curved portion 72 extends into slot 62 and passage 40, and second flat portion 74 rests on exterior surface 40 of guide portion 52, see FIG. 2. Curved portion 72 is shaped to rest on rounded portion 64 of sleeve 16 and to extend into passage 40 when bit 14 is separated from handle 12. In the preferred embodiment, no portion of spring 18 extends outward from the exterior surface 42 of sleeve 16 beyond ribs 58.

Figure 7:
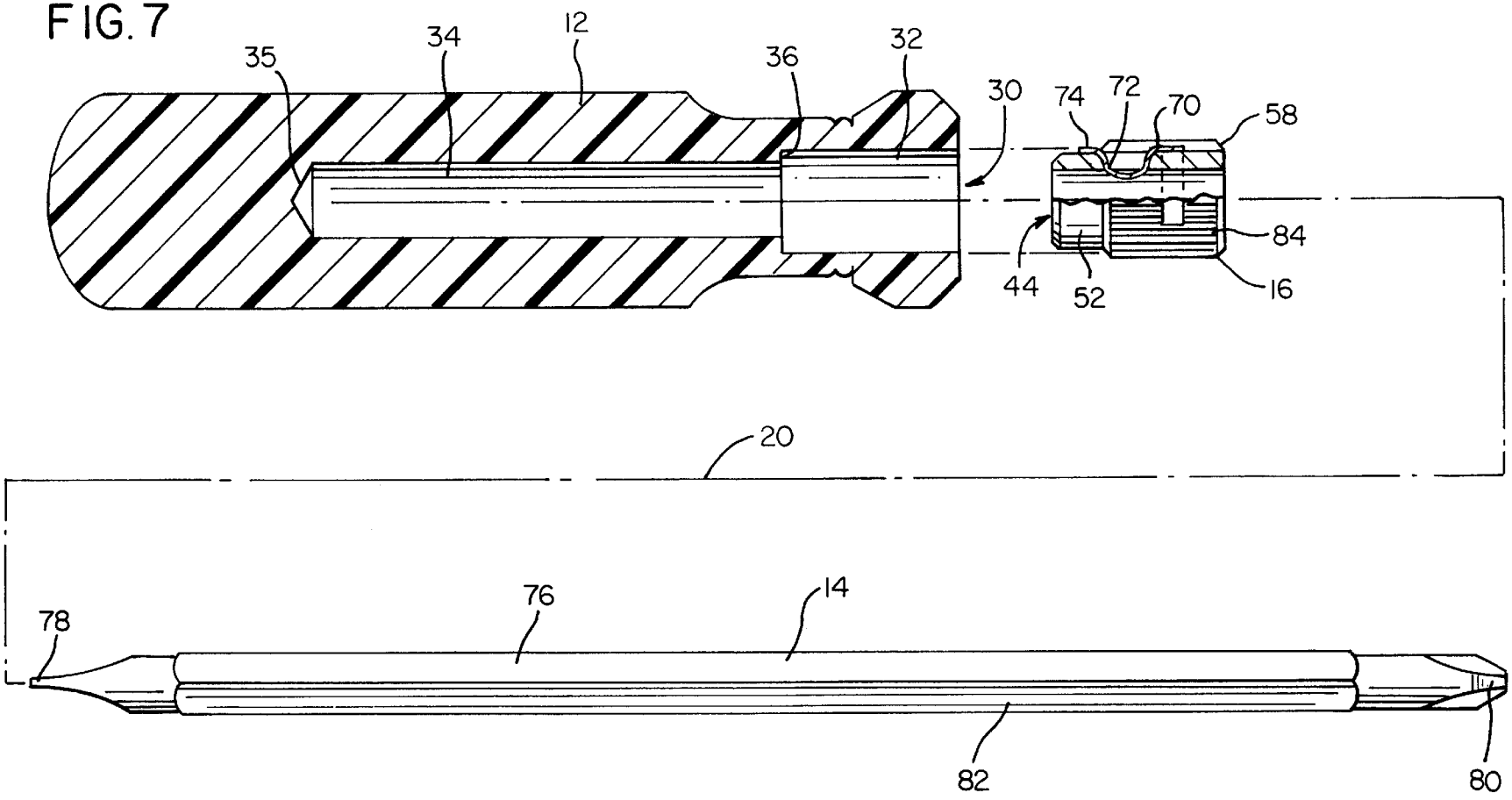
FIG. 7 is cross-sectional view of the tool during assembly.

Bit 14 includes a shaft 76 extending between first end 78 and second end 80, see FIG. 7. As shown in FIG. 2, first end 78 can butt up against beveled end 35 of second chamber 34 during use. As shown in the preferred embodiment, first end 78 has a flat point screwdriver tip while second end 80 has a Phillips point screwdriver tip. As will be appreciated by those skilled in the art, the first and second ends 78, 80 may have any desired shape according to the intended application. For example, first and second ends 78, 80 may include hex-shaped ends, star-shaped ends or point-shaped ends. Further, any combination of shaped ends may be used.

Shaft 76 includes a hexagonally-shaped central portion 82 for engagement with hexagonally-shaped portion 50 of sleeve 16. The hexagonally-shaped portions 50, 82 cooperate to limit relative rotation between handle 12 and bit 14 when torques are applied through handle 12 to bit 14 to a workpiece during use. As will be appreciated by those skilled in the art, other shapes may be used to prevent relative rotation between bit 14 and handle 12 around the longitudinal axis 20. For example, portions 50, 82 may be square-shaped, triangle-shaped, rectangle-shaped or diamond-shaped without departing from the scope of the present invention.

For the assembled tool 10 shown in FIG. 1, spring 18 applies sufficient force on bit 14 to retain bit 14 in handle 12 during normal handling and use. The curved portion 72 of spring 18 is positioned along on the flat hexagonal surfaces of shaft 76 to provide maximum contact between spring 18 and bit 14. If a different bit 14 is desired, the user may remove bit 14 from handle 12 by applying sufficient force along longitudinal axis 20 to overcome the force applied by spring 18. Once the bit 14 is removed, the curved portion 72 of spring 18 extends into passage 40 as shown in FIG. 7. A new bit 14 may be inserted in handle 12 by applying sufficient force along longitudinal axis 20 to slide bit 14 past curved portion 72 until the end of bit 14 abuts the beveled end 35 of second chamber 34. The beveled surfaces 48 allow for easy positioning of bit 14 into sleeve 16. The amount of force applied by spring 18 on bit 14 is dependent to the extent in which curved portion 72 extends into passage 40, the thickness of second portion 68, and the material used to form spring 18. Preferably, spring 18 is formed of a metallic material such as steel. As will be appreciated by those skilled in the art, other resilient materials such as plastic or hard rubber may be used to form spring 18. Preferably, the first and second portions 66, 68 of spring 18 are formed of a integral structural element but may be formed from distinct structural elements and secured together using conventional means.

Referring now to FIG. 7, a method of assembly of tool 10 is illustrated. The first portion 66 of spring 18 is slid over collar 60 of sleeve 16 to frictionally engage and hold spring 18 in position over sleeve 16. The second portion 68 is positioned in slot 62 so that curved portion 72 extends into passage 40. Spring 18 engaged with sleeve 16 form a sleeve assembly 84. Guide portion 52 of sleeve assembly 84 is positioned adjacent bore 30 in handle 12. Guide portion 52 is inserted into the first chamber 32 of bore 30. Sufficient force is applied to force the sleeve assembly into the first chamber 32. Ribs 58 frictionally engage the inner surface of first chamber 32 to retain the sleeve assembly 84 in handle 12. Preferably, sufficient force is applied to sleeve assembly 84 until the first end 44 abuts shoulder 36. Once sleeve assembly 84 is positioned in first chamber 32, spring 18 is permanently secured inside handle 12.

Handle 12 may be formed of a variety of plastics conventionally known in the art. Sleeve 16 and bit 14 may be formed of a variety of materials including metals such as steel.

Having described the invention in detail and by reference to preferred embodiments thereof, it will be apparent that modifications and variations are possible without departing from the scope of the invention which is defined in the appended claims.

What is claimed is:

1. A reversible bit tool comprising:

a handle having a first end and a second end, said handle defining a longitudinal axis extending from said first end to said second end, said handle including a bore through said second end;

a bit including first and second ends and a shaft extending between said first and second ends, said first end of said bit extending into said bore in said handle;

a sleeve mounted in said bore, said sleeve including an exterior surface engaging said bore of said handle and an interior surface defining a passage therethrough for receiving said shaft of said bit and adapted to prevent rotation of said bit around a longitudinal axis thereof, said longitudinal axis of said bit being substantially parallel to said longtudinal axis of said handle, said sleeve including a collar and a slot in said sleeve communicating with said passage; and a spring including a first portion at least partially encircling said collar of said sleeve and a second portion extending into said slot in said sleeve and frictionally engaging a surface of said shaft of said bit to retain said bit in said handle, said second portion of said spring extending generally longitudinally away from said first portion of said spring in a direction substantially parallel to said longitudinal axis of said handle, said second portion of said spring includes a first end and a second end with said first end forming a junction point with said first portion of said spring, said second portion of said spring defining an axis extending from said first end of said second portion of said spring to said second end of said second portion of said spring such that said axis of said second portion of said spring is substantially parallel to said longitudinal axis of said handle and substantially perpendicular to said first portion of said spring.

2. A tool as claimed in claim 1 in which said exterior surface of said sleeve includes a plurality of upstanding, longitudinally extending ribs.

3. A tool as claimed in claim 2 in which said exterior surface of said sleeve includes a substantially smooth portion generally adjacent to said ribs.

4. A tool as claimed in claim 2 in which said slot in said sleeve is positioned between adjacent ribs.

5. A tool as claimed in claim 2 in which said second portion of said spring extends between adjacent ribs and into said slot.

6. A tool as claimed in claim 2 in which there are an absence of ribs in said collar of said sleeve.

7. A tool as claimed in claim 5 in which neither portion of said spring extends outwardly from said exterior surface of said sleeve beyond said ribs.

8. A reversible bit tool comprising:

a handle including a bore therein;

a bit including first and second ends and a shaft extending between said first and second ends, said first end of said bit extending into said bore in said handle;

a sleeve mounted in said bore, said sleeve including an exterior surface engaging said bore of said handle, said exterior surface of said sleeve including a plurality of upstanding, longitudinally extending ribs and a substantially smooth portion generally adjacent to said ribs, said sleeve further including an interior surface defining a passage therethrough for receiving said shaft of said bit and adapted to prevent rotation of said bit around a longitudinal axis thereof, said sleeve including a collar having an absence of said ribs and a slot in said sleeve communicating with said passage, said slot in said sleeve positioned between adjacent ribs; and a spring including a first portion at least partially encircling said collar of said sleeve and a second portion extending into said slot in said sleeve and frictionally engaging a surface of said shaft of said bit to retain said bit in said handle.

9. A tool handle comprising:

a handle having a first end and a second end, said handle defining longitudinal axis extending from said first end to said second end, said handle including a bore through said second end;

a sleeve mounted in said bore, said sleeve including an exterior surface engaging said bore of said handle and an interior surface defining a passage therethrough, said sleeve including a collar and a slot in said sleeve communicating with said passage; and a spring including a first portion at least partially encircling said collar of said sleeve and a second portion extending into said slot in said sleeve, said second portion of said spring extending generally longitudinally away from said first portion of said spring in a direction substantially parallel to said longitudinal axis of said handle, said second portion of said spring including a first end and a second end, said first end forming a junction point with said first portion of said spring, said second portion of said spring defining an axis extending from said first end of said second portion of said spring to said second end of said second portion of said spring such that said axis of said second portion of said spring is substantially parallel to said longitudinal axis of said handle and substantially perpendicular to said first portion of said spring.

10. A tool handle as claimed in claim 9 in which said exterior surface of said sleeve includes a plurality of upstanding, longitudinally extending ribs.

11. A tool handle as claimed in claim 10 in which said exterior surface of said sleeve includes a substantially smooth portion generally adjacent to said ribs.

12. A tool handle as claimed in claim 10 in which said slot in said sleeve is positioned between adjacent ribs.

13. A tool handle as claimed in claim 10 in which said second portion of said spring extends between adjacent ribs and into said slot.

14. A tool handle as claimed in claim 10 in which there are an absence of ribs in said collar of said sleeve.

15. A tool handle as claimed in claim 14 in which neither portion of said spring extends outwardly from said exterior surface of said sleeve beyond said ribs.

16. A method of assembling a tool handle comprising the steps of:

providing a handle having a first end and a second end, said handle defining a longitudinal axis extending from said first end to said second, said handle including a bore through said second end;

providing a sleeve, said sleeve including an exterior surface including a plurality of upstanding, longitudinally extending ribs and an interior surface defining a passage therethrough, said sleeve including a collar and a slot in said sleeve communicating with said passage;

providing a spring including a first portion adapted to at least partially encircle said collar of said sleeve and a second portion adapted to extend into said slot in said sleeve, said second portion of said spring extending generally longitudinally away from said first portion of said spring in a direction substantially parallel to said longitudinal axis of said handle, said second portion of said spring including a first end and a second end, said first end forming a junction point with said first portion of said spring, said second portion of said spring defining an axis extending from said first end of said second portion of said spring to said second end of said second portion of said spring such that said axis of said second portion of said spring is substantially parallel to said longitudinal axis of said handle and substantially perpendicular to said first portion of said spring, sliding said first portion of said spring over said collar to frictionally engage said collar and hold said spring in position on said sleeve forming a sleeve assembly, said second portion of said spring extending into said slot on said sleeve;

positioning said sleeve assembly adjacent said bore in said handle; and applying sufficient pressure to said sleeve assembly to force said sleeve assembly into said bore, said ribs on said sleeve frictionally engaging the inner surface of said bore to retain said sleeve assembly in said handle.

17. A method as claimed in claim 16 in which said exterior surface of said sleeve includes a substantially smooth portion generally adjacent to said ribs, said smooth portion of said sleeve positioned adjacent said bore prior to said step of applying sufficient pressure to said sleeve assembly.

18. A method as claimed in claim 16 in which said slot in said sleeve is positioned between adjacent ribs.

19. A method as claimed in claim 16 in which said second portion of said spring extends between adjacent ribs and into said slot.

20. A method as claimed in claim 16 in which there are an absence of ribs in said collar of said sleeve.

21. A method as claimed in claim 20 in which neither portion of said spring extends outwardly from said exterior surface of said sleeve beyond said ribs.

22. A reversible bit tool comprising:

a handle including a bore therein;

a bit including first and second ends and a shaft extending between said first and second ends, said first end of said bit extending into said bore in said handle;

a sleeve mounted in said bore, said sleeve including an exterior surface having a plurality of upstanding, longitudinally extending ribs engaging said bore of said handle and an interior surface defining a passage therethrough for receiving said shaft of said bit and adapted to prevent rotation of said bit around a longitudinal axis thereof, said sleeve including a collar and a slot in said sleeve communicating with said passage, said slot in said sleeve being positioned between adjacent ribs; and a spring including a first portion at least partially encircling said collar of said sleeve and a second portion extending into said slot in said sleeve and frictionally engaging a surface of said shaft of said bit to retain said bit in said handle.

23. A tool handle comprising:

a handle including a bore therein;

a sleeve mounted in said bore, said sleeve including an exterior surface having a plurality of upstanding, longitudinally extending ribs engaging said bore of said handle and an interior surface defining a passage therethrough, said sleeve including a collar and a slot in said sleeve communicating with said passage, said slot in said sleeve being positioned between adjacent ribs; and a spring including a first portion at least partially encircling said collar of said sleeve and a second portion extending into said slot in said sleeve.

* * * * *